United States Patent [19]

O'Brien et al.

[11] 4,023,895

[45] May 17, 1977

[54] ELECTROSTATOGRAPHIC APPARATUS

[75] Inventors: John F. O'Brien, Webster; Oscar G. Hauser, Rochester, both of N.Y.

[73] Assignee: Xerox Corporation, Stamford, Conn.

[22] Filed: Oct. 23, 1975

[21] Appl. No.: 625,338

Related U.S. Application Data

[62] Division of Ser. No. 518,138, Oct. 25, 1974.

[52] U.S. Cl. ..... 355/3 R; 96/1 TE

[51] Int. Cl.[2] ..... G03G 15/044

[58] Field of Search ..... 355/3 R, 3 TE, 11, 17; 96/1 TE

[56] References Cited

UNITED STATES PATENTS

| | | | |
|---|---|---|---|
| 3,084,061 | 4/1963 | Hall | 355/17 X |
| 3,254,998 | 6/1966 | Schwertz | 355/11 X |
| 3,502,408 | 3/1970 | Brodie | 355/16 |
| 3,703,335 | 11/1972 | Hoffman et al. | 355/8 X |
| 3,719,484 | 3/1973 | Egnaczak | 355/8 X |

*Primary Examiner*—L. T. Hix
*Assistant Examiner*—Kenneth C. Hutchison

[57] ABSTRACT

An improved method for varying the Gamma in a TESI electrostatic imaging system is disclosed which provides for positioning a surface of a photoconductive body and a surface of a dielectric body in virtual contact whereby an air gap exists between a portion of the surfaces. The photoconductive body is imaged by exposure to electromagnetic radiation in image configuration while an electric potential difference is simultaneously established across the photoconductive and dielectric bodies. The resulting field in illuminated areas has a magnitude for causing ionization in the air gap and causing a charge pattern to transfer to the dielectric body. The process Gamma is controlled by employing a pulse imaging technique. Pulse imaging is provided by repeatedly interrupting the potential difference, the exposure or both.

6 Claims, 7 Drawing Figures

ELECTROSTATOGRAPHIC APPARATUS

This is a division of application Ser. No. 518,138, filed 10/25/74.

This invention relates to the formation of images by electrostatographic techniques. The invention relates more particularly to an improved method and apparatus for the formation and transfer of an electrostatic image to a receiving body.

In one form of electrostatographic imaging, a latent electrostatic image charge pattern is formed through the use of a photoconductive body and is transferred to the surface of a receiver sheet, such as a dielectric coated paper. This technique which is known as TESI (an acronym for transfer of electrostatic images) is provided in one arrangement through the use of a photoconductor which is mounted on a transparent, conductive base material which is maintained in virtual contact with the dielectric coating of the receiver sheet and a bias voltage is applied between the substrates of the two bodies. The surface of a receiver sheet, although appearing to the unaided eye to be smooth, is in fact relatively rough and the fractional area of contact between the photoconductor and a receiver sheet is relatively small. As a result, the surfaces are separated over most of the surface area by a small air gap on the order of 10u in thickness.

Electrostatic image formation has heretofore been provided with this assembly by projecting electromagnetic radiation in image configuration at the transparent substrate of the photoconductor while simultaneously establishing the bias field between these bodies. In operation, the electric field across the air gap is increased due to charge transport in the photoconductor until dielectric breakdown is initiated in the air gap. This ionization causes the deposition of ions on the surface of the receiver sheet. Because the charge is deposited on the receiver sheet in illuminated areas, the technique is generally an optical negative-to-positive system. The projected illumination intensity pattern thereby generates a corresponding charge density pattern on the surface of the receiver sheet. This accumulation of charges on the photoconductor and receiver sheet decreases the electric field in the air gap below the level necessary to sustain the ionization process and the charge transfer thereby automatically terminates. Upon completion of this exposure, the substrates are coupled to a common potential, e.g. ground potential, and the receiver sheet is separated from the photoconductive body. A latent, electrostatic image remains on the receiver sheet which is then developed by contacting the receiver sheet with electroscopic toner particles. The density of the developed image is generally proportional to the charge density of the surface of the receiver body. This form of imaging is referred to as Static TESI since the transfer of charge occurs while the surfaces are in virtual contact and there is no relative motion between the surfaces.

A process characteristic, referred to as Gamma, is the slope of the curve of output density versus input density. It is desirable at times to adjust the Gamma during the imaging process in order to alter the contrast or tonal relationship between the imaged subject and the reproduction thereof. This has been accomplished heretofore by varying the development system and/or the amplitude of the conventionally applied D. C. bias level. These techniques for altering the Gamma of the process are either relatively difficult to accomplish or are not adequately effective in that they do not provide sufficient latitude in variation of Gamma.

Accordingly, it is an object of this invention to provide an improved electrostatographic method and apparatus.

Another object of the invention is to provide an improved method and apparatus for varying Gamma in a TESI reproduction process.

We have discovered that the Gamma in a TESI process can be varied by pulse imaging. In accordance with features of the method of this invention, a method of forming an electrostatic image comprises the steps of positioning a surface of a photoconductive body and a surface of a dielectric body in virtual contact whereby an air gap exists between a portion of the surfaces, and, pulse imaging by exposing the photoconductive body to electromagnetic radiation in image configuration and applying an electric potential difference across the photoconductive and dielectric body having a magnitude for causing ionization in the air gap. An imagewise charge pattern is thereby formed on the surface of the photoconductive body and is transferred to the dielectric body to form an electrostatic charge pattern thereon. Pulse imaging is provided by repeatedly interrupting the potential difference, the exposure, or both.

In accordance with features of the apparatus of this invention, there is provided an electrostatographic imaging apparatus comprising a body of photoconductive material having a surface thereof, a body of dielectric material having a surface thereof which is positioned in virtual contact with said photoconductive surface whereby an air gap exists between a portion of the surfaces, and pulse imaging means for exposing the photoconductor to electromagnetic radiation in image configuration and applying an electric potential difference across said bodies having a magnitude for causing ionization in said air gap. An imagewise charge pattern is thereby formed on the surface of the photoconductive body and is transferred to the dielectric body to form an electrostatic charge pattern thereon. The pulse imaging means is adapted for repeatedly interrupting the potential difference, the exposure, or both.

These and other objects and features of the invention will become apparent with reference to the following specification and to the drawings whereon:

Figure 1:
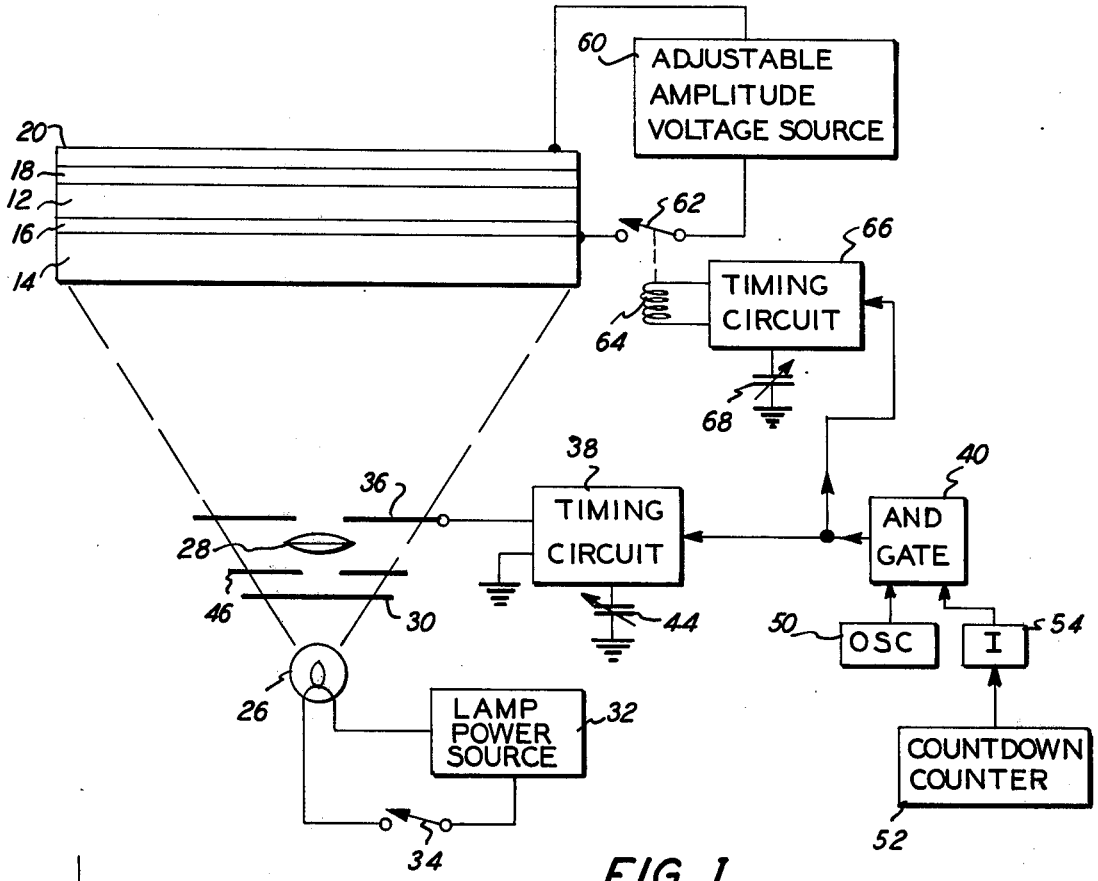
FIG. 1 is a schematic diagram illustrating one embodiment of the apparatus of the present invention.
Figure 5:
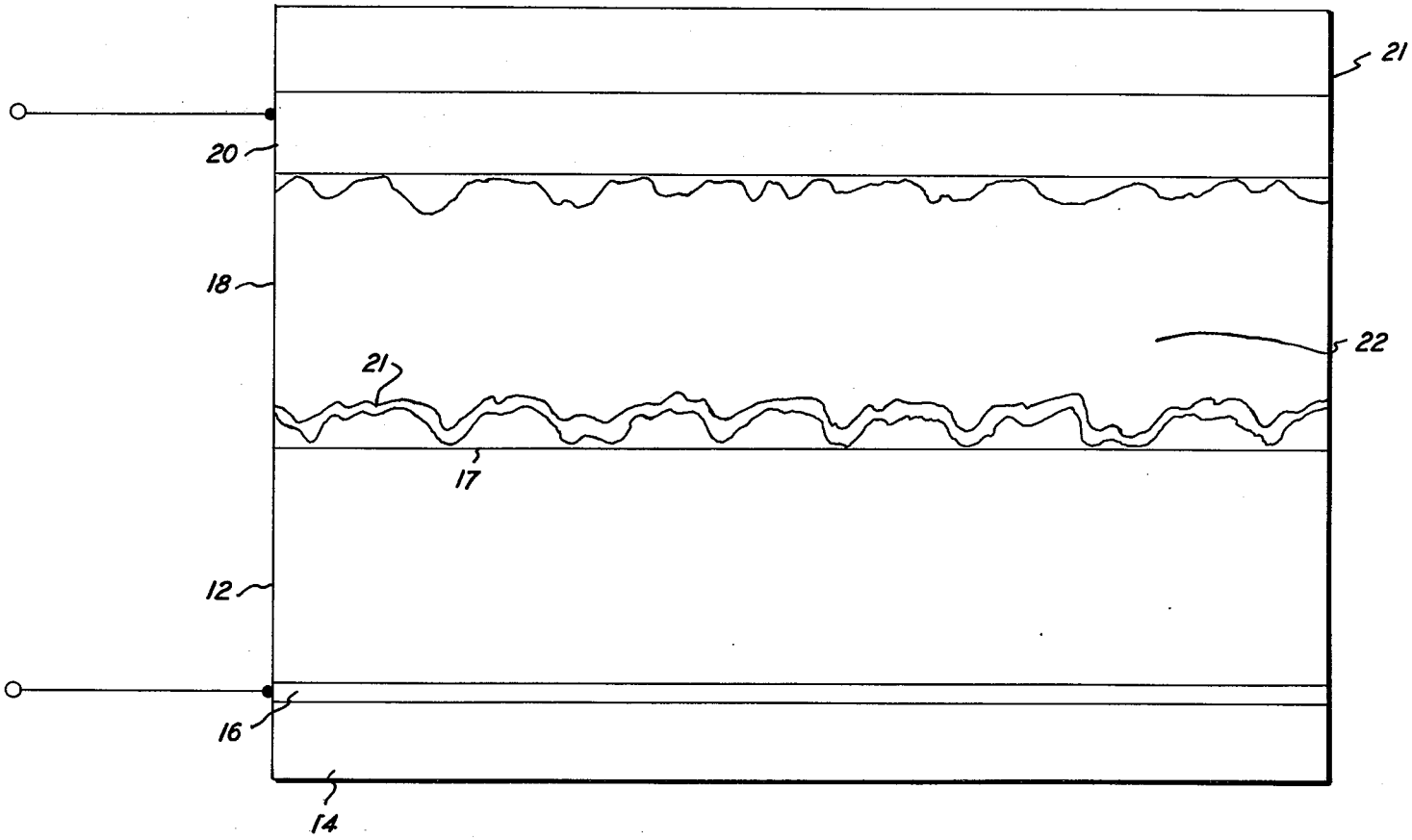
FIG. 5 is an enlarged diagram illustrating in detail the arrangement of photoconductive and dielectric bodies utilized in the present invention.

Referring now to the drawings, and particularly to FIG. 1, one embodiment of the apparatus for practicing the invention is shown to include a photoreceptor in contact with a receiver body. The photoreceptor comprises a photoconductive material such as a mixture of 50% by volume of $Cd_2SSe$ in an organic binder such as a polyester resin. The photoreceptor may comprise alternative photosensitive materials such as selenium or its alloys. The substrate upon which the photoconductive material is deposited comprises a plate glass 14 which is over-coated with a nearly transparent, conductive interface film 16 formed of a material such as tin oxide. The substrate material is available commercially and is known as NESA glass. Since the photoconductor 12 is exposed to light through the substrate, the conductive layer 16 must have a uniform, low opacity. The photoconductor 12 is typically 30 to 120 microns thick and exhibits a relatively smooth surface 17 (FIG. 5). The surface roughness of amorphous plates is less than or equal to 1 micron and for binder photoconductive plates is normally less than or equal to 4 microns peak to peak.

The receiver comprises a dielectric coated conductive body 18 which is maintained in contact with a conductive sheet 20. The conductive body comprises, for example, a paper base material which is treated with a salt to increase its conductivity. Preferably the conductive body of the receiver sheet should have a bulk resistivity of less than $10^9$ohm-cm. A thin dielectric layer of about 5 micron thickness is coated on the sheet. Dielectric coated conductive sheets are available commercially. An example suitable for use with the arrangement of FIG. 1 is Crown-Zellerback, type CZ 1900 paper. As illustrated in FIG. 5, surface variations exist on the receiver body sheet and are on the order of 5 to 15 microns deep and the average width of an air pocket is about 200 to 300 microns. The average air gap between the bodies is about 5 to 9 microns wide. The contact area of the receiver sheet with the relatively smooth photoreceptor surface is between 0.01 to 0.1 percent of the total projected surface area of the contact zone. The electrode 20 comprises tin foil or other conductive sheet or film mounted on a comformable pad 21 which is positioned adjacent the dielectric coated body and which makes electrical contact therewith. A uniform pressure on the order of 30 psi or less can be applied to the receiver through the pad 21 in order to eliminate curl or other similar imperfections in the receiver. As illustrated in FIG. 5, the dielectric coated body makes virtual contact with the surface 17 of the photoconductor in that while the peaks of the surface of the dielectric coated body contact the surface 17, spaces remain which contain or entrap air and in which spaces ionization occurs in accordance with the process described herein. Alternatively, the photoreceptor surface 17 is relatively rough while the coated dielectric sheet surface is relatively smooth.

Figure 2:
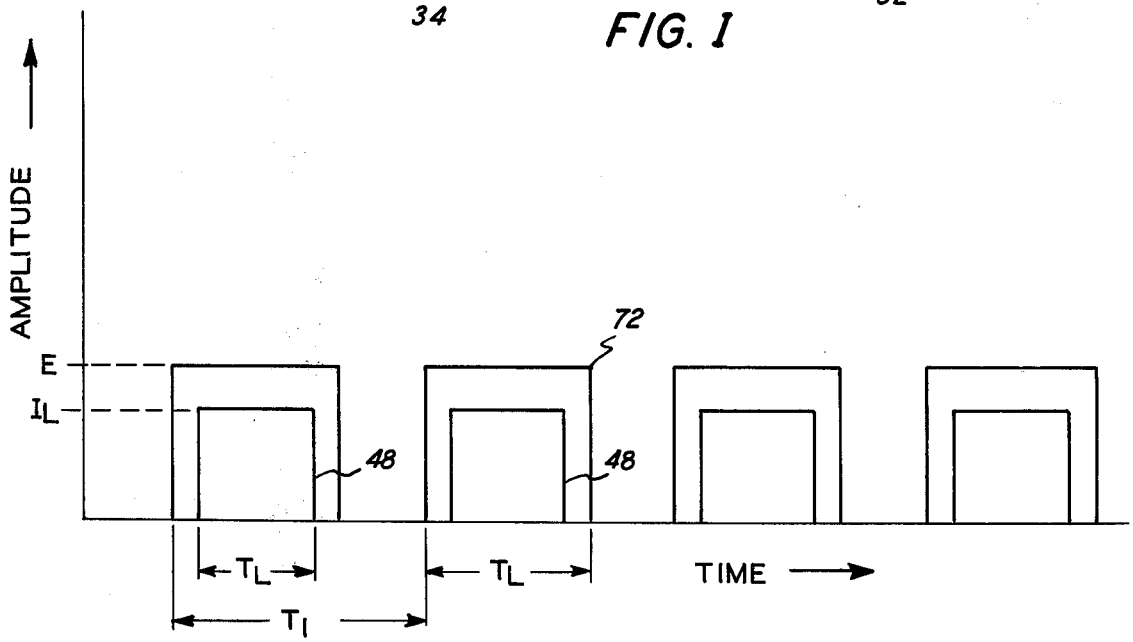
FIG. 2 is a diagram illustrating the application of imaging radiation and biasing potential in the arrangement of FIG. 1.

As illustrated in FIG. 1, exposure is provided by projecting electromagnetic radiation in image configuration on the photoreceptor. Illumination from a light source 26 is provided and an image, for example of a transparency, is projected onto the photoreceptor by a lens arrangement, 28. A power source 32 for energizing the lamp 26 is provided and is coupled thereto through a switch 34. A timer circuit 38 which comprises, for example, a monostable multi-vibrator is triggered by a signal from an AND gate 40. An output of the timer circuit 38 activates an electronic shutter 36 and determines the time period $T_L$ (FIG. 2) during which the photoreceptor is exposed. A monostable multi-vibrator includes an RC timing circuit which determines the output pulse duration $T_L$. A variable capacitor 44 is provided for adjusting this duration. The illumination intensity level $I_1$ is established by a manually controlled iris 46.

A predetermined number of exposure pulses 48 having a predetermined pulse interval $T_1$ is provided by the trigger pulses which are provided at the output of AND gate 40. This AND gate requires dual coincident inputs from an oscillator 50 and a countdown counter 52, the output of which is applied through an inverter 54 to the AND gate 40. The oscillator 50 determines the pulse rate while the countdown counter 52 can be preset to determine the number of pulses to be generated. The output of a lowest order digit of the counter 52 is coupled through the inverter 54 to the AND gate 40 and enables the AND gate until such time as the counter counts down to zero. At this time, the AND gate is disabled and the illumination pulses are discontinued.

A pulsated potential difference which is coincident in time with the illumination pulses 48 is applied across the dielectric body and the photoreceptor.

An adjustable amplitude voltage source 60 is provided and is coupled to the electrode 20 and to the conductive layer 16 through relay contacts 62. The relay contacts are normally open and are closed through energization of a relay coil 64 which is excited by a timer circuit 66. The timer circuit 66 is similar to the timer circuit 38 and, for example, comprises a monostable multi-vibrator which is triggered by output pulses from the gate 40 and whose period is adjustable by a capacitor 68 in an RC circuit of the multi-vibrator. The amplitude E of these pulses 72 is adjustable by adjusting the output amplitude of the voltage source while the pulse width is varied by adjustment of the capacitor 68. A delay in the application of the illumination pulses 48 can be provided by applying the triggering pulses from the AND gate 40 to the timing circuit 38 through a delay circuit such as a delay line or other conventional delay circuit means.

For a given total light exposure of the photoconductor, the quantity of charge which is deposited on the receiver sheet and the output image density depend on various parameters such as the photoconductor thickness, the magnitude of the bias voltage, and the photoconductor sensitivity. If the photoconductor and development system parameters are maintained constant, we have discovered that the Gamma or the ratio of the output density to the input density can be varied by pulse imaging. A means for pulse imaging is illustrated in FIG. 1. The output image density provided through pulse imaging described herein depends on the pulse durations $T_L$ and $T_v$, the pulse duty cycle $T_1$ for a given total exposure and the total number of pulses. Thus, the Gamma of the system is controlled by varying these parameters.

Figure 7:
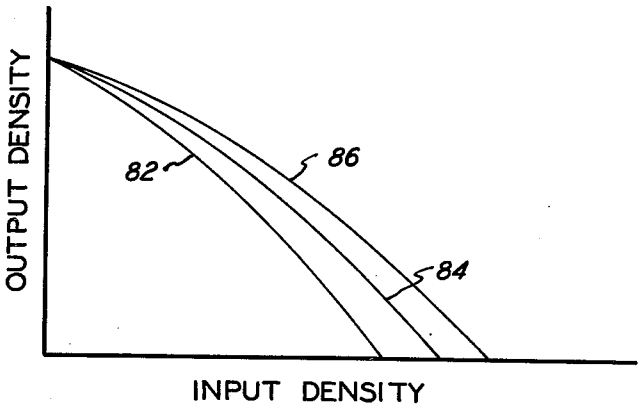
Figure 6:
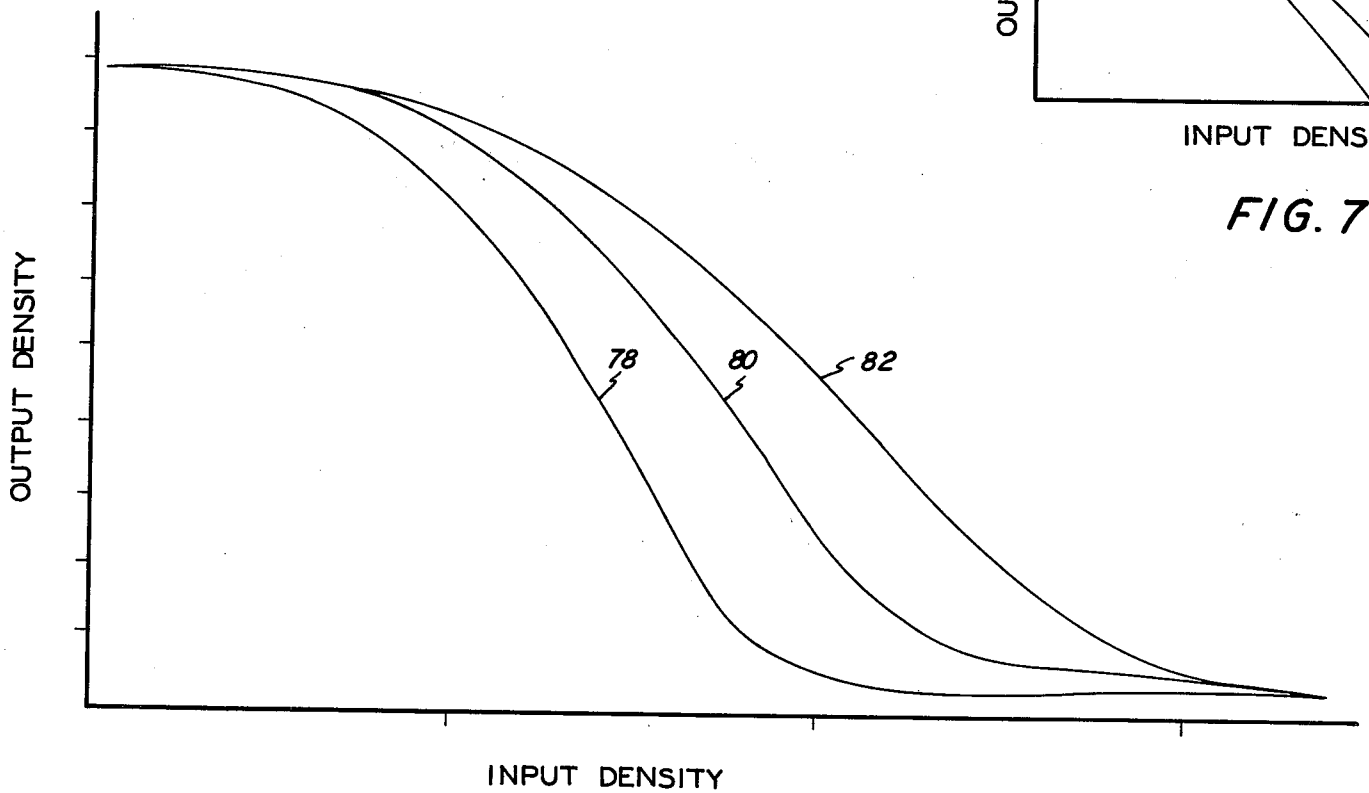
FIG. 6 is a diagram illustrating the variation of Gamma as a function of the number of pulses; and, FIG. 7 is a diagram illustrating the variation of Gamma as a function of pulse width.

The effect of pulse imaging is to change the range of light intensity levels to which the system will respond without changing useful illumination or the maximum output density. Useful illumination is the integrated intensity during the time in which both the electric potential difference and exposure occur. This is illustrated in FIG. 6 by curves of input density versus output density for the imaging technique for the same useful illumination. The slope of the curve 78 represents the Gamma for the application of 12 one-half second pulses, the curve 80 represents the Gamma for the application of 6 two-second pulses while the curve 82 represents the Gamma for the application of 3 four-second pulses. Curve 78 represents a Gamma of approximately 4 while the curve 82 represents a Gamma of approximately 1. The curves of FIG. 6 are provided for a constant useful illumination at a constant potential difference for a variable number of pulses. FIG. 7 illustrates the output versus input density for a constant useful illumination and a constant number of pulses but wherein the duration of the voltage pulse $T_v$ is varied. The curve 84 represents a voltage pulse duration $T_v$, the curve 86 represents a voltage pulse duration $2T_v$, while the curve 82 represents a voltage pulse duration of $\frac{1}{2}T_v$. For each curve, the duration $T_L$ is less than $\frac{1}{2}T_v$.

Figure 3:
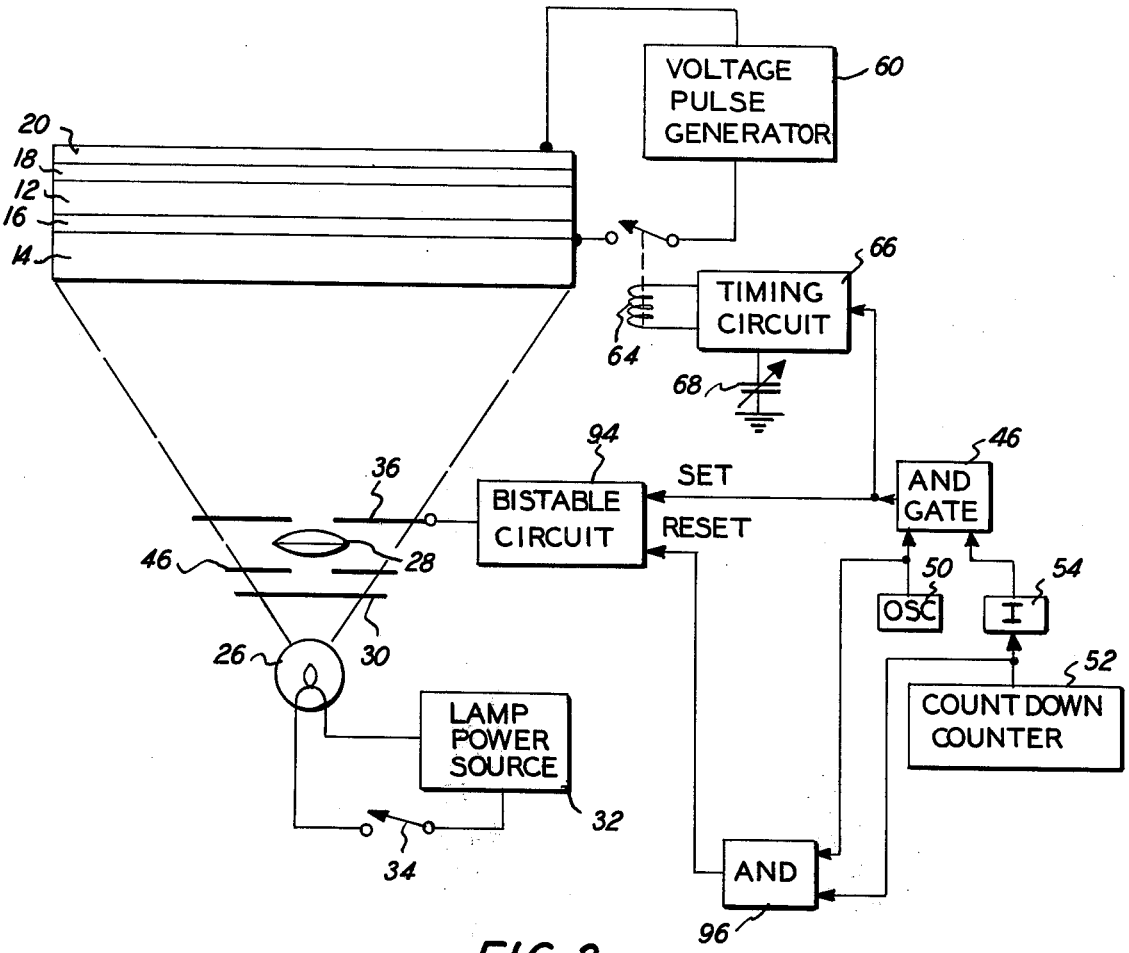
FIG. 3 is a schematic diagram illustrating another embodiment of the present invention.
Figure 4:
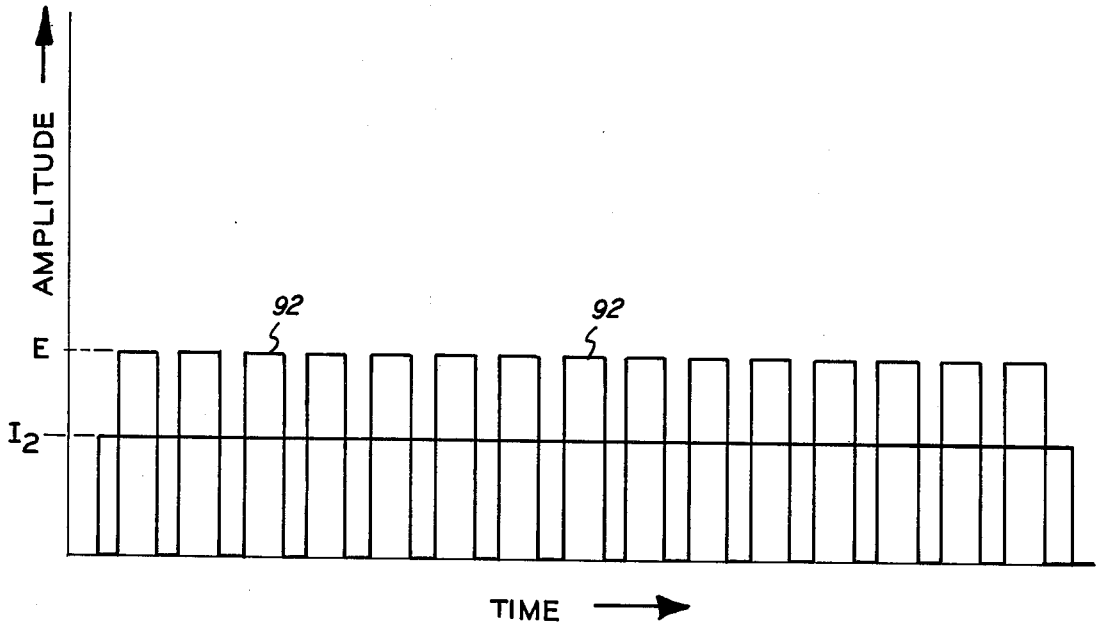
FIG. 4 is a diagram illustrating the application of imaging radiation and biasing potential with the arrangement of FIG. 3.

FIG. 3 illustrates an alternative embodiment of the apparatus for practicing the invention and FIG. 4 illustrates the corresponding waveforms provided by this arrangement. Those elements of FIG. 3 which have been described hereinbefore with respect to FIG. 1 and which performs similar functions bear the same reference numerals. The apparatus of FIG. 3 is adapted for providing a continuous illumination of constant intensity while repeatedly interrupting the application of the potential difference across the photoconductor and the dielectric body. As can be seen from FIG. 4, the illumination intensity $I_L$ is substantially constant over an interval of time while the potential difference is repeatedly interrupted or is established by a sequence of pulses 92. A substantially uniform illumination level $I_L$ is established by setting a bistable circuit 94 which comprises for example a flip-flop circuit. The circuit 94 is set to a condition for energizing the electronic shutter 36 by output pulses from the gate 40. Application of these same pulses to the timing circuit 66 can be delayed by a conventional delay circuit such as a delay line. These same pulses trigger the timing circuit 66 causing the generation of the potential difference pulses 92. As the counter 52 attains the predetermined count, the AND gate 40 is disabled thereby interrupting the application of pulses to the timing circuit 66 and interrupting the potential pulses 92. An output from the countdown counter 52 along with an output from the oscillator 50, at this time, enable and AND gate 96 which resets the bistable circuit 94 thereby deactivating the shutter 36 and terminating the exposure.

An improved method and apparatus for varying Gamma in a TESI imaging process has thus been described. Pulsed imaging provides a means for a machine operator to control the process Gamma by simple electronics without the need for adjusting the useful illumination or the development process and provides for a variation in contrast or tone characteristic of the reproduced image.

While there have been described particular embodiments of this invention it will be appreciated by those skilled in the art that variations may be made thereto without departing from the spirit of the invention and the scope of the appended claims.

What is claimed is:

1. An electrostatographic imaging apparatus comprising:

a body of photoconductive material having a surface thereof;

a body of dielectric material having a surface thereof positioned in virtual contact with said photoconductive surface wherein an air gap exists between a portion of said surfaces; and, pulse imaging means for exposing the photoconductive body to electromagnetic radiation in image configuration and applying a potential difference between said dielectric body and said photoconductive body, said potential difference having a magnitude for causing ionization in said air gap whereby an imagewise charge pattern which is formed at said surface of said photoconductive body is transferred to said dielectric body surface to form an electrostatic charge pattern thereon, and for repeatedly interrupting the application of either said potential difference or exposure to activating radiation or both.

2. The apparatus of claim 1 wherein said means for pulse imaging includes means for exposing said photoconductive body to a substantially uniform level of electromagnetic radiation in image configuration and for simultaneous and repeatedly interrupting said potential difference across said dielectric body and said photoconductive body.

3. The apparatus of claim 1 wherein said means for pulse imaging includes means for repeatedly interrupting said potential difference across said dielectric body and said photoconductive body and for simultaneously and repeatedly interrupting the exposure of said photoconductive body to electromagnetic radiation in image configuration.

4. The apparatus of claim 3 wherein said exposure to electromagnetic radiation occurs coincident in time with said potential difference and occurs for a relatively shorter interval of time than said potential difference.

5. The apparatus of claim 1 wherein said photoconductor comprises selenium.

6. The apparatus of claim 1 wherein said photoconductor comprises cadmium sulfoselenide in an organic binder.

* * * * *